US008099218B2

(12) United States Patent
Glee et al.

(10) Patent No.: US 8,099,218 B2
(45) Date of Patent: Jan. 17, 2012

(54) PAVING SYSTEM AND METHOD

(75) Inventors: Katherine C. Glee, Peoria, IL (US); Dean R. Potts, Maple Grove, MN (US); Paul T. Corcoran, Washington, IL (US); Terry L. Rasmussen, Princeville, IL (US)

(73) Assignee: Caterpillar Inc., Peoria, IL (US)

( * ) Notice: Subject to any disclaimer, the term of this patent is extended or adjusted under 35 U.S.C. 154(b) by 1082 days.

(21) Appl. No.: 11/998,660

(22) Filed: Nov. 30, 2007

(65) Prior Publication Data

US 2009/0142133 A1 Jun. 4, 2009

(51) Int. Cl.
*G06F 19/00* (2011.01)

(52) U.S. Cl. ..... 701/50; 366/4; 366/7; 366/12; 366/22; 366/25; 524/59; 524/60; 524/62; 524/64; 524/68; 428/35.7; 428/36.8; 428/36.92; 428/440; 428/462; 106/271; 106/274; 106/277; 106/278; 106/279; 427/138; 427/388.1; 427/388.5; 427/389.8; 206/447; 206/524.7

(58) Field of Classification Search ..... 701/50; 366/4, 7, 12, 25, 22, 57, 228, 233; 524/59, 524/60, 62, 64, 68, 70, 71, 476, 534, 575.5; 428/35.7, 36.8, 36.92, 440, 462, 489; 106/271, 106/274, 277, 278, 279, 280, 281.1; 427/138, 427/388.1, 388.5, 389.8; 404/17, 72, 77, 404/79, 92, 95; 220/260, 288; 206/447, 206/524.7; 208/44; 516/43
See application file for complete search history.

(56) References Cited

U.S. PATENT DOCUMENTS 3,028,596 A 4/1962 McGillem et al.
3,880,542 A * 4/1975 Mullen ..... 404/101
3,901,616 A * 8/1975 Greening ..... 404/102
4,300,853 A * 11/1981 Jones ..... 404/92
4,422,778 A 12/1983 Shestopalov et al.
5,471,391 A 11/1995 Gudat et al.
5,493,494 A 2/1996 Henderson
5,774,070 A 6/1998 Rendon
5,942,679 A * 8/1999 Sandstrom ..... 73/78
5,952,561 A 9/1999 Jaselskis et al.
(Continued)

OTHER PUBLICATIONS

Moropoulou, Avdelidis, Koui, Kakaras, Flaw Detection . . . , published prior to Feb. 27, 2007.

(Continued)

*Primary Examiner* — James Trammell
*Assistant Examiner* — McDieunel Marc
(74) *Attorney, Agent, or Firm* — Liell & McNeil

(57) ABSTRACT

A method of operating a paving system includes establishing a plan for paving a work area which is based on a positional temperature model. The method further includes receiving temperature data for paving material and comparing the temperature data with data predicted by the positional temperature model. Operation of the paving system is adjusted where actual data differs from model predicted data. A paving system and control system are provided having an electronic control unit configured to compare electronic temperature data with a positional temperature model for paving material. The electronic control unit can control machines of the paving system based on comparing actual data with model predicted data, and can further update either or both of a plan for paving a work area and the positional temperature model itself based on differences between actual data and model predicted data. A complete temperature profile of a paving work area, including a comparison with the model may be recorded in computer readable memory for forensic and predictive analysis.

21 Claims, 4 Drawing Sheets

U.S. PATENT DOCUMENTS

| | | | | |
|---|---|---|---|---|
| 6,122,601 | A | 9/2000 | Swanson et al. | |
| 6,236,923 | B1 | 5/2001 | Corcoran et al. | |
| 6,460,006 | B1 | 10/2002 | Corcoran | |
| 6,475,821 | B2 | 11/2002 | Honda | |
| 6,498,978 | B2 * | 12/2002 | Leamy et al. | 701/100 |
| 6,686,716 | B1 * | 2/2004 | Predina et al. | 318/560 |
| 6,749,364 | B1 * | 6/2004 | Baker et al. | 404/84.5 |
| 6,915,216 | B2 | 7/2005 | Troxler et al. | |
| 6,973,821 | B2 | 12/2005 | Corcoran | |
| 7,191,062 | B2 | 3/2007 | Chi et al. | |
| 7,321,825 | B2 * | 1/2008 | Ranalli | 701/205 |
| 2007/0032245 | A1 * | 2/2007 | Alapuranen | 455/456.1 |
| 2007/0191514 | A1 * | 8/2007 | Reinke et al. | 524/59 |
| 2008/0292398 | A1 * | 11/2008 | Potts | 404/83 |
| 2008/0298892 | A1 * | 12/2008 | Megli et al. | 404/90 |
| 2009/0317186 | A1 * | 12/2009 | Glee et al. | 404/75 |

OTHER PUBLICATIONS

Flir Systems, Thermography Paves . . . , 2000, Flir Systems, Incorporated.

Asphalt Contractor Staff, New Control Systems . . . , Jul. 18, 2007, pp. 1-6, www.forconstructionpros.com.

* cited by examiner

PAVING SYSTEM AND METHOD

TECHNICAL FIELD

The present disclosure relates generally to systems and methods used in paving, and relates more particularly to evaluating temperature data of paving material during paving for use in controlling and/or logging paving system operation and performance.

BACKGROUND

A typical system for paving a work area such as a parking lot or road can include numerous different machines. Supply machines such as haul trucks may be used to deliver paving material for distribution and compaction on a work surface. Paving machines may be supplied directly from the haul trucks, or from material transfer vehicles. Paving machines typically distribute paving material and perform a preliminary compaction of a "mat" of paving material with a screed mounted at the back end of the paving machine. In many systems, the paving machine is followed relatively closely by a compacting machine known in the art as a breakdown roller. Another compacting machine known as an intermediate roller often follows the breakdown roller, and a final finish roller may follow behind the intermediate roller in some systems. Various factors can affect the efficiency and success of a paving job, such as operator experience with the various machines, environmental conditions and temperature of the paving material at different stages of the paving process. Working paving material under optimum temperature conditions has long been recognized as important, but has heretofore been difficult to ensure and verify without manual measurements by support personnel.

Paving material is typically obtained at a relatively high temperature at an asphalt plant. Depending in part upon the distance a supply machine has to travel to reach a work site, traffic, ambient temperature, etc., the asphalt can cool somewhat prior to delivery. Progress of the paving machines and compactors can also vary, and haul trucks may have to wait to offload the paving material if paving has slowed. The manner in which paving material is delivered to a paving machine can also vary among systems, e.g. via a material transfer vehicle or "MTV" versus direct delivery from a haul truck. Due to the variables which can affect the timing of the various events in a paving process, temperature of the paving material when it eventually reaches the paving machine can be at least somewhat unpredictable. Once transferred into a paving machine, paving material will tend to cool further prior to its being distributed onto a work surface. The extent of cooling once within the paving machine can vary depending on the temperature of paving material at delivery, environmental factors, proper versus improper operation of the paving machine, etc. In some instances, paving material may segregate within a paving machine, and thus relatively cooler and relatively warmer pockets of material within the machine may exist, leading to unexpected temperature gradients in the paving material once distributed on the work surface. When paving material is finally discharged and distributed by the paving machine, treated via its screed, and ready to be compacted by the various compacting machines, its temperature can vary significantly from an expected temperature, and may even be non-uniform from one paved region to the next due to unintended segregation or poor mixing. As alluded to above, being able to work paving material under certain conditions such as optimum temperature can often be of paramount importance.

For example, depending upon the particular mix of paving material, it may have a temperature range known in the art as the "tender zone" where attempted compacting is unlikely to succeed. When paving material is in the tender zone it is prone to shoving and there may be a "wave" in front of the compactor drum. It is well known in the paving arts that successful compaction may take place when the paving material temperature is either above the tender zone or below the tender zone, but not within the tender zone. Ideally, breakdown rollers, mentioned above, follow the paving machine closely enough that they compact paving material prior to its cooling to the tender zone. Intermediate rollers typically follow sufficiently far behind the breakdown roller that the paving material has cooled below the tender zone by the time the intermediate roller reaches a particular stretch of paving material. It is also typically desirable to employ the finish roller prior to paving material cooling to a point at which it becomes too hard.

For most paving systems, there is thus at least a rough theoretical relative timing between the various paving activities, such as paving versus compacting, which can be expected to result in optimum paving quality. Engineers have recognized for some time that paving material composition, environmental conditions, machine speed and spacing, and other variables can make predicting a temperature for paving material at a particular time challenging. While manual measurements or estimates of time, air temperature, asphalt temperature, wind speed, humidity, cloud cover, and other factors can be used in decision making, machine operators and paving site managers still rely to a great extent on experience and guesswork in managing operations.

In addition to the challenges to successfully paving in the first place, many jurisdictions now mandate logging data relating to paving material temperature and machine activities during a paving operation. Records of such operations at a paving site allow paving contractors to establish that paving was performed within specifications, and are commonly related to contract validation and bonuses as well as predictive and forensic aspects of construction. Standard procedure for this type of data logging has heretofore relied principally on manual observation and recording of the temperature of paving material while working a particular area.

One strategy directed at improving operation and efficiency of paving equipment is known from U.S. Pat. No. 6,749,364 to Baker et al. ("Baker"). In Baker's approach, a pavement temperature monitoring system is used on a paver vehicle and sends signals to a display device generating a graphical image of a formed material mat temperature profile. Based on the displayed temperature profile, operational parameters of the paver vehicle or compactor vehicle are purportedly adjusted to provide an acceptable formed mat. Baker's technique may be superior to certain earlier systems and manual approaches to analyzing temperature and adjusting operation, however, there remains ample room for improvement.

The present disclosure is directed to one or more of the problems or shortcomings set forth above.

SUMMARY

In one aspect, a method of operating a paving system which includes at least one of a paving machine, a compacting machine or a supply machine, is provided. The method includes the steps of establishing a plan for paving a work area with the paving system which is based at least in part on a positional temperature model for paving material recorded in a computer readable memory, and outputting machine navigation signals for the at least one of a paving machine, a compacting machine or a supply machine which are based at least in part on the plan. The method further includes the steps of receiving electronic data that includes temperature data for a paving material subsequent to outputting the machine navigation signals, and comparing the electronic data with data predicted by the positional temperature model.

In another aspect, a paving system includes at least one machine having a frame and ground engaging elements mounted to the frame. The at least one machine includes at least one of a paving machine, a compacting machine, or a supply machine. The paving system further includes a control system having an electronic control unit, a computer readable memory and a memory writing device, the electronic control unit being configured via the memory writing device to record a positional temperature model on the computer readable memory, and also configured to record plan data for paving a work area on the computer readable memory which is based at least in part on the positional temperature model. The electronic control unit is further configured to receive electronic data which includes temperature data for paving material with which the at least one machine interacts and to compare the electronic data with data predicted by the positional temperature model.

In still another aspect, a paving control system includes a computer readable memory, a memory writing device and an electronic control unit. The electronic control unit is configured via the memory writing device to record a positional temperature model for paving material on the computer readable memory, and also configured to record plan data for paving a work area with a paving system on the computer readable memory which is based at least in part on the positional temperature model. The electronic control unit is further configured to receive electronic data including temperature data for a paving material and to output a signal based at least in part on a difference between the electronic data and data predicted by the positional temperature model.

DETAILED DESCRIPTION

Figure 1:
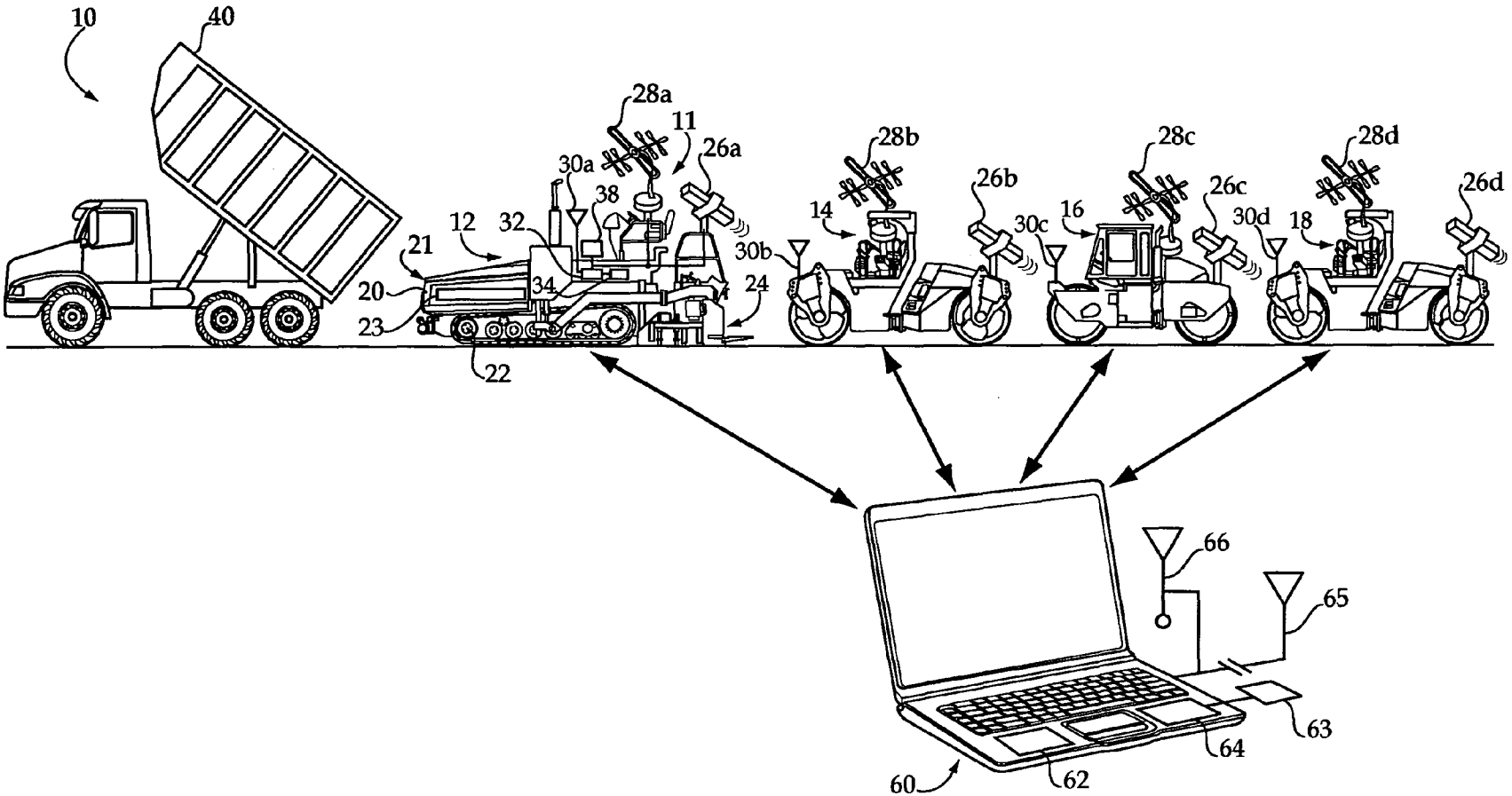
FIG. 1 is a diagrammatic view of a paving system according to one embodiment.

Referring to FIG. 1, there is shown a paving system 10 according to the present disclosure. Paving system 10 may include one or more machines, for example a plurality of different machines, or even a plurality of identical machines in certain embodiments. Each of the machines of paving system 10 is configured to interact with a paving material, typically performing a particular type of work thereon. In one example embodiment, paving system 10 includes a paving machine 12, and three compactor machines 14, 16 and 18. One or more supply machines 40 such as a haul truck, a material transfer vehicle, etc., may be provided which supply paving material for paving a work surface to the other machines of system 10. While only certain machines are shown, it should be appreciated that for relatively large paving jobs, additional paving machines, additional compactors, supply machines, etc. may be part of system 10. Moreover, while in many embodiments system 10 will be used in paving one particular work area, such as a stretch of road, a parking lot, etc., in other embodiments, additional machines at other work areas may be part of a large integrated paving system that includes the machines of system 10 shown in FIG. 1. For example, two or more "paving trains" each having a plurality of machines, located on different sections of a road might all fairly be considered part of one paving system as contemplated herein. In still other embodiments, the control and data logging aspects of the present disclosure may be embodied in a paving system having only a single machine. In all versions, the present disclosure is considered to provide substantial advantages over state of the art paving systems with regard to planning system operation, as well as both real time control for optimizing paving quality and forensic and predictive analysis of paving parameters, as further described herein.

In the illustrated embodiment, paving machine 12 includes a frame 20 having a set of ground engaging wheels or tracks 16 mounted thereto, as well as a screed 24 for working paving material in a conventional manner. Paving machine 12 may further include a hopper 21 for storing paving material supplied via supply machine 40 or another supply machine and a conveyor system 23 which transfers paving material from hopper 21 to screed 24. Paving machine 12 may further include a receiver **28*a* mounted to frame 20 which can receive electronic signals comprising position data for machine 12. Position data received via receiver 28*a* may include geographic position data such as GPS signals or local positioning signals, or position data indicative of a position of machine 12 relative to other machines of system 10. Alert commands, navigation commands such as start commands, stop commands, machine speed commands, conveyor speed commands, travel direction commands, etc., may also be received via receiver 28*a*, as well as data signals from other machines of system 10 including paving material temperature data and machine position data as described herein. Paving machine 12 may further include a signaling device such as a transmitter 30*a* for outputting control signals to other machines, or outputting data signals, mounted to frame 20. A display device 38, such as an LCD display device, may be mounted to frame 20 for viewing by an operator. In one embodiment, display device 38 may be configured to display a map of a work area, including icons, etc. representing one or more of the machines of system 10**.

Display device 38 may also be configured to display a temperature map of a work area, for reasons which will be apparent from the following description. A computer readable medium or memory 34, such as RAM, ROM, flash memory, a hard drive, etc., may also be mounted to frame 20. In one embodiment, computer readable memory 34 may have program instructions comprising computer executable code recorded thereon for carrying out one or more of the control functions of the present disclosure, further described herein. Computer readable memory 34 may also be configured to have electronic data associated with operation of system 10 recorded thereon via a memory writing device, including temperature data for paving material with which system 10 interacts, position data, time data and lift number data for example. In one embodiment, computer readable memory 34 may have temperature data from a temperature sensor **26*a*, mounted for example on screed 24, recorded thereon during operation, as well as position data received via receiver 28*a*. Sensor 26*a* may comprise an optical temperature sensor such as an infrared camera whereas in other embodiments sensor 26***a* may comprise a non-optical sensor such as a digital or analog thermometer.

While sensor 26*a* is shown mounted on screed 24 such that it can scan paving material temperature deposited on a work surface and located behind screed 24 as paving progresses, the present disclosure is not thereby limited. In other embodiments, sensor 26*a* might be mounted at a different location on machine 12, and could even sense paving material temperature within paving machine 12. A paving control system 11, of which computer readable memory 34 may be a part, may also be provided, which includes an electronic control unit 32 coupled with each of receiver 28*a*, transmitter 30*a*, display device 38, memory 34, and sensor 26*a*. Electronic control unit 32 may comprise a control module which includes the memory writing device mentioned above.

Compacting machine 14 may comprise a "breakdown" roller which will ordinarily follow relatively closely behind paving machine 12, such that it can compact paving material distributed by paving machine 12 while the paving material is still relatively hot. Compacting with machine 14 when paving material is still relatively hot allows machine 14 to perform a relatively large proportion of the total compaction desired for a particular lift of paving material, as relatively hotter asphalt in the paving material can flow relatively readily and is thus readily compacted. In one embodiment, compacting machine 14 will be used primarily to compact paving material which has not yet cooled to a "tender zone" temperature range. As discussed above, the "tender zone" is a temperature range at which paving material moves or shoves in front of the advancing compactor drum, making attempted compaction generally undesirable. The actual temperature range at which a paving material will be within the tender zone will depend upon the particular paving material mix, and may enter the tender zone when the temperature is between about 115° C. and about 135° C. Paving material may be below the tender zone when its temperature falls to between about 65° C. and about 95° C. One specific known mix will enter a tender zone at 116° C. and firm up again when the temperature has cooled below 93° C. Accordingly, it will typically be desirable to compact paving material with machine 14 when the temperature is above this range.

Compacting machine 14 may further include a receiver 28*b* which can receive position signals and/or control commands such as machine navigation signals, similar to paving machine 12. Compacting machine 14 may also include a temperature sensor 26*b* mounted thereon which can sense a temperature of paving material with which compacting machine 14 is interacting or with which it has interacted, again similar to that of paving machine 12. A transmitter 30*b* may also be mounted on machine 14 to transmit position data indicative of a relative or geographic position of machine 14, as well as electronic data such as temperature data acquired via sensor 26*b*. In some embodiments, compacting machine 14 may include a vibratory apparatus, as will be familiar to those skilled in the paving arts.

Compacting machine 16 may comprise an intermediate roller which compacts paving material already compacted at least once by compacting machine 14. Compacting machine 16 may also include a receiver 28*c*, a temperature sensor 26*c* and a transmitter 30*c*, each having functions which may be similar to that of the corresponding features of the other machines described herein. It will typically be desirable to compact paving material with machine 16 after the paving material has cooled to a temperature below the tender zone. Compacting machine 16 may include apparatus for sensing a smoothness and/or stiffness of paving material known to those skilled in the paving arts, and transmitter 30*c* may be equipped to transmit data which includes smoothness and/or stiffness data for use in system control and/or contract validation, etc., as described herein.

In the illustrated embodiment, each of machines 14 and 16 transmits position and temperature data which can be processed via electronic control unit 32 and used in displaying a temperature map via display device 38, and may be further used in controlling machine positioning, operation, and other factors as described herein. Paving machine 12 might serve as one command center at which paving progress is monitored and controlled, and data recorded, and from which control commands such as machine navigation signals to the other machines are transmitted. System 10 could alternatively be configured, however, such that any one of the other machines serves one or more of these functions, and in some embodiments a remote control station may be employed. Accordingly, the location and distribution of the various pieces of sensing equipment, data processing and recording, map display, etc., may vary substantially from the exemplary embodiment shown in FIG. 1.

Compacting machine 18 may likewise include a receiver 28*d* and a transmitter 30*d*. Compacting machine 18 may comprise a finish roller which performs a final squeeze of the paving material in a particular lift, and may follow relatively closely behind compacting machine 16. In some instances, it will be desirable to compact paving material with compacting machine 18 prior to its cooling below a temperature in the range of about 50° C. to about 65° C. Even where paving material is compacted to a specified relative compaction state, if compaction takes place at too low a temperature, the aggregate in the paving material may crack, creating voids which can negatively impact the long term viability of the compacted surface. To this end, compacting machine 18 might also include a temperature sensor 26*d* to verify whether the final compaction is taking place at an appropriate paving material temperature.

As discussed above, control, monitoring and data recording relating to system 10 may take place from a variety of locations, either onboard one of machines 12, 14, 16, 18, 40 or at a separate command center. It is contemplated that for at least certain paving jobs, system 10 may be used with one or more control stations separate from each of the respective machines. A control station 60 may be a part of system 10, which may comprise a computer station monitored by a paving foreman, technician, etc., and may receive signals from any or all of the machines of paving system 10, and may be configured to output control commands to any or all of the machines of paving system 10. As discussed above, control system 11 may include an electronic control unit for processing electronic data generated during operation of system 10, and outputting appropriate control commands to vary machine operation, as well as storing electronic data. Control station 60 may serve as an alternative or supplemental command center where personnel can monitor paving progress, view maps of the work area, etc. To this end, control station 60 may also include a receiver 66, an electronic control unit 62, a memory 64 and a transmitter 65. Electronic control unit 62 might also comprise a memory writing device 63 configured to record electronic data from any of machines 12, 14, 16, 18 or 40 on memory 64.

Control station 60 may also be configured to communicate with supply machines and/or even an asphalt plant to speed up or slow down paving material production, delivery, etc., based on progress of paving system 10. In a related aspect, control station 60 might be used to control supply machine traffic by directing supply machines to a particular paving machine of system 10 or by directing supply machines to a particular job site. For example, if paving at one job site or by one particular paving machine is halted for any of a variety of reasons, it may be desirable to direct supply machines to locations where paving material is needed, or where excess paving material can be best accommodated, rather than stopping the supply chain. It should be appreciated that any or all of the control and data recording aspects of system 10 might take place at control station 60, via a laptop computer, a PDA, cell phone, etc. Thus, control system 11 might be located at least in part at control station 60, rather than on one of the machines of system 10. Typically, control station 60 will be in two-way communication with at least a portion of the machines of system 10, and also in one-way or two-way communication with machines and personnel associated with a supply chain for paving material. Additional stations (not shown), such as a quality control station and a validation station may also be used. In some instances, a quality control station may be used to record data relating to comparisons between pre-established paving specifications and actual paving parameters. The quality control station could also be used to make any necessary changes in system operation between paving process stages, for example changes in the operation and/or speed, spacing, etc. of compacting machines 14 and 16. Quality control changes might take place via computer, or by a technician. A validation station may also be set up at a work site to record information relating to paving specifications and paving quality, etc., for accessing by personnel other than paving contractors.

As mentioned above, system 10 is considered to provide significant improvements over earlier paving systems with regard to real time control over paving system operation, as well as gathering information relating to paving quality. This is made possible in part by the recognition that the temperature of paving material at different stages of a paving process can be predicted and adjustments to paving system operation can be made in real time to optimize quality where measured temperature differs from expected temperature. This differs from earlier strategies such as Baker, discussed above, which focus on adjusting operation for future work only after determining that paving progress has not proceeded optimally. The insights set forth herein also enable establishing a plan for paving system operation even prior to starting work in a manner calculated to provide the best chance of meeting specifications. It also establishes a novel standard against which data recorded during paving can be compared after a paving job is completed, for example for predictive and forensic purposes, and for refinement of planning strategies for paving.

Control over system 10 during operation may be based on comparing electronic data, including temperature data received via one or more of sensors 26*a-c*, with a positional temperature model for paving material which is recorded in computer readable memory. In particular, data such as actual temperature data may be compared with data predicted by the positional temperature model. As further described herein, where sensed temperature data differs from expected data, operation of system 10 can be adjusted. In one embodiment, the positional temperature model may be recorded in memory 34 of control system 11, and electronic control unit 32 may perform the comparison of sensed data with model predicted data. As discussed above, however, the model may be recorded in a computer readable memory at a different location and the data processing may be carried out by a different control unit, such as at control station 50 or on a machine of system 10 other than machine 12.

As used herein, the term "positional temperature model" should be understood to include any model which can be used to predict an expected paving material temperature at an identified or identifiable position. The position might be a position within a supply machine, a position within paving machine 12, or a position on a paving material mat. The position on a paving material mat may be a position relative to one or more of the machines of system 10, or it might be a geographic position. From the time at which paving material leaves an asphalt plant to the time at which it is worked or evaluated by the last machine of a paving system, it will typically be cooling, albeit potentially at different rates. Any of the many possible positions within the various machines, or anywhere on the surface being paved is a position at which the paving material's temperature might be predicted via a positional temperature model, and a sensed temperature compared therewith. Accordingly, a computer-generated prediction of a temperature of paving material at a single position would meet the intended definition of "positional temperature model." For example, a computer-based prediction of a paving material temperature of X within Y meters of a back end of screed 24 during paving could be a positional temperature model. Similarly, a computer-based prediction of a paving material temperature of Z within hopper 21 of paving machine 12 could also be a positional temperature model. Each of these examples, and many other contemplated instances, includes an identifiable position at which paving material temperature can be predicted and compared with an actual temperature. Computer-generated predictions of paving material temperature at many positions would also meet the intended definition of positional temperature model. For instance, outputs of paving material temperature from sensors 26*a-c* may be associated with a position of a paving material mat relative to a position of the corresponding machine or relative to a mapped position.

The use of a positional temperature model as described herein and comparison with actual temperature data is contemplated to allow the identification of situations where paving material temperature is at or within an acceptable range of an expected temperature at a given position, as well as situations where paving material temperature differs from an expected temperature at a given position. This information may be leveraged to adjust operational parameters of one or more of the machines of paving system 10, such as machine speed, machine spacing, conveyor speed, frequency and/or amplitude of vibrations from a vibratory compacting machine, machine path, etc. The selected machine type for compacting could also be based on this information, such as using an intermediate roller instead of a finish roller. The comparison between actual temperature data and predicted temperature data, may also be recorded in computer readable memory for contract validation, predictions of road performance and durability over time, and forensic analysis of pavement failures and the like. In this manner, the present disclosure addresses each of two concerns of primary importance to the paving industry, controlling machine operation to achieve optimum quality, and generating a reliable record that establishes if specifications are met for a particular paving job, as well as how much a paving job might differ from specifications.

In one embodiment, the positional temperature model may be a temperature decay model, predicting an expected temperature of paving material at a given position based on expected temperature decay over time. The rate at which temperature of paving material is expected to decay can vary based on a multiplicity of factors. These may include such factors as the composition of the paving material, its temperature when picked up from the asphalt plant, time until delivery, the mat thickness, the ambient air temperature, underlying soil or other substrate temperature, wind speed, solar gain, precipitation, humidity, and whether windrows are used in supplying paving material or whether it is delivered directly to paving machines from haul trucks.

In one embodiment, the positional temperature model may be initialized prior to beginning work by entering values for one or more of the foregoing parameters, and possibly others. Once the positional temperature model is initialized, an expected temperature of paving material at one or more positions within or relative to one of the paving machines of system 10 or at a position on the mat may be predicted based on the model. In one example, the positional temperature model might be used to predict a paving material temperature immediately behind each of machines 12, 14 and 16. A predicted temperature map of a work area, including paving material temperatures at each of the selected positions behind machines 12, 14 and 16 may be generated, for example via display 38. Once paving begins, temperatures at each of the selected positions may be sensed via sensors 26*a-c*, and a comparison made between sensed temperatures and predicted temperatures. The comparison may be made by an operator or technician viewing one or more temperature maps, for example a sensed temperature map versus a predicted temperature map via maps displayed on display 38. Positions at which paving material temperature is sensed may be determined based on position signals received via receivers 28*a-d*. The comparison may additionally or alternatively be performed via computer, for example by electronic control unit 32.

In one embodiment, electronic control unit 32 may be configured to generate a signal which is based on comparing temperature data received via one or more of temperature sensors 26*a-d* with a temperature predicted by the positional temperature model for the positions scanned with temperature sensors 26*a-d*. The signal may comprise a display signal to display 38 which can indicate to personnel viewing a map displayed on display device 38 that a difference between sensed temperature and predicted temperature exists. The signal may also comprise a machine navigation signal which directs an operator on one of machines 12, 14, 16 and 18 to start, stop, speed up, slow down, change direction, repeat a pass across a particular area of the mat, etc. In one specific embodiment, signals might be transmitted directing two or more of machines 12, 14, 16 and 18 to adjust the relative spacing therebetween to avoid compacting an area of the mat which is within a predefined temperature range such as the tender zone, or to ensure that a particular area of the mat is compacted while in a predefined temperature range. Where appropriate, a machine navigation signal could be broadcast via transmitter 30*a*. The signal might also comprise a control signal to propulsion elements of machine 12 to adjust speed and potentially also to conveyor 23 to adjust speed to accommodate changes in speed of machine 12. In still other instances, signals could be transmitted to supply machine 40 to indicate an expected change in demand for paving material, to an asphalt plant to request a change in output, etc.

The signals generated in response to comparing the sensed temperature data with model predicted data could also simply be recorded in memory such as memory 34. Such signals might comprise a signal indicating that specifications are met, or a signal indicating that specifications are not met. For example, system 10 might create a log of temperature data for a position directly behind machine 12, demonstrating that paving material at that selected position was consistently within a specified temperature range throughout an entire paving operation for contract validation purposes. In some embodiments, temperature mapping data for an entire work site, for a plurality of lifts of paving material, including machine position data, will be recorded in computer readable memory, establishing an entire temperature history for a paving job. Model comparison data, as described herein, which corresponds with the temperature data may also be recorded. Sensed paving material stiffness and paving material smoothness could also be recorded. In certain versions, the present disclosure can allow a paving contractor or auditor to establish exactly what temperature each portion of the mat was at any given time, what the model-predicted temperature for that portion of the map was and where each machine of system 10 was at any given time, enabling a detailed analysis of the paving job from start to finish.

As mentioned above, a positional temperature model may also be used in planning a particular paving job. For example, in some instances the optimum spacing and/or speed of machines of system 10 may vary based on the rate of cooling of paving material. Where paving material is predicted by the model to cool relatively rapidly, for example because of low ambient temperatures, it may be desirable for machines 12, 14, 16 and 18 to travel relatively faster and relatively closer together to enable compaction to take place prior to the paving material cooling below a specified temperature. Where paving material is predicted by the model to cool relatively more slowly, for example because of a high ambient temperature, it may be desirable for machines 12, 14, 16 and 18 to travel relatively more slowly and/or relatively further apart.

While the conditions upon beginning a paving job can be used to initialize the positional temperature model and establish a plan relative to machine positioning, machine speed, etc., the conditions may change. For example, ambient temperature, precipitation, humidity, cloud cover, etc., may all change throughout the course of work day, affecting the validity and/or accuracy of a positional temperature model. In some instances, the positional temperature model may be updated to account for changing conditions, by inputting updated model parameters. The plan may therefore be changed in accordance with the updated model, and system 10 may be operated according to the updated plan by outputting appropriate navigation signals, speed signals, etc. to adjust operation.

Figure 2:
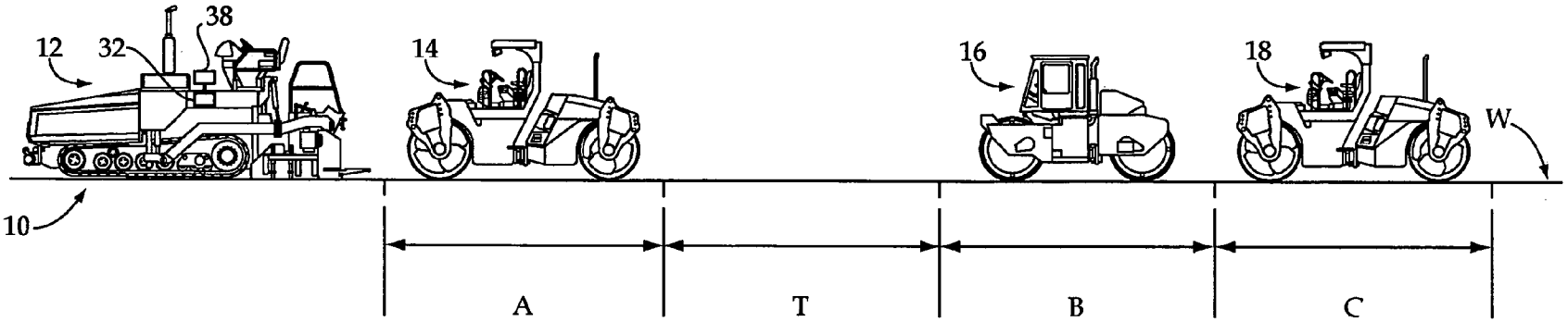
FIG. 2 is a diagrammatic view of the paving system of FIG. 1 shown in a first machine positioning configuration.

Turning now to FIG. 2, there are shown machines 12, 14, 16 and 18 of system 10 in relation to a work surface W. Paving machine 12 has distributed a mat of paving material on work surface W, and each of machines 14, 16 and 18 is following behind paving machine 12, successively compacting the mat. As mentioned above, the machines of system 10 may be operating at a specified speed, or with a specified spacing, etc., which is based on an expected temperature decay of paving material. In other words, paving system 10 will typically be proceeding in some sort of planned manner which is based on the expected temperatures of paving material at different stages in the paving process, as predicted by the positional temperature model. Compacting machine 14 may be following relatively closely behind paving machine 12, such that it is compacting a portion of the mat, zone A in FIG. 2, which is at a temperature above a tender zone temperature. A portion of the mat which is behind machine 14 may actually be in the tender zone, shown as zone T in FIG. 2.

To avoid compacting on the portion of the mat within the tender zone, machine 16 may be spaced behind machine 14 to allow the paving material time to cool to below the tender zone, and compacts a relatively cooler portion of the mat, shown as zone B in FIG. 2. Compacting machine 18 may be positioned behind machine 16 to compact the still cooler portion of the mat, zone C, which has not yet cooled below a minimum specified temperature. It will be recalled that a map of a particular portion of a work area may be displayed via display 38 of machine 12, or a different display at a different location. Each of machines 12, 14, 16 and 18 may also be represented on the map such that an operator or foreman can view the temperature of paving material in relation to the position of the various machines, based on position signals from each of the machines. Thus, FIG. 2 may be thought of as one such map, wherein paving material temperature on work surface W and machine type and location is displayed on display 38. A different display strategy, such as a two-dimensional bird's eye view, illustrating paving material in different colors corresponding to different temperatures might also be used.

It will be recalled that each of machines 12, 14, 16, 18 may be scanning temperature of paving material continuously or at least periodically as paving progresses. Any suitable strategy for sensing paving material temperature may be used. In one embodiment, sensors 26*a-d* may be rotated to sweep back and forth, scanning the regions of the mat directly behind the corresponding machine across a width of the mat approximately identical to the machine's width. Since machines 12, 14, 16 and 18 will typically be traveling forward along a work surface, the area that is actually scanned may consist of a zigzagging path back and forth behind the corresponding machine, comprising substantially less than the entire portion of the mat with which the corresponding machine interacts. For purposes of processing the temperature data, as well as displaying the temperature data to an operator or foreman, etc., and storing the temperature data, the work area may be divided into segments perpendicular to the machine path having a width equal to the machine width. Each of the segments may have its temperature determined based on the points of the scanning path which intersect the subject segment. In other words, while the zigzagging path will only actually scan a relatively small portion of the mat, the temperature of an entire segment of a mat perpendicular to the machine's path which has just been worked can be estimated by the relatively small number of points, potentially only one, of the zigzagging path which actually intersect each segment. One advantage of this strategy is that a relatively simple and inexpensive temperature sensor may be used, such as a non-optical sensor, and the total amount of data may be substantially less than that required if attempting to record temperature information for an entire work area.

It may also be desirable in some instances to capture thermal images of an entire work surface by scanning numerous locations of a mat with which a machine has interacted or is about to interact, then associating each of the locations with position data. For example, a thermal camera or the like, or multiple point sensors, could initially produce data corresponding to the two-dimensional surface of the mat. Next, each data point, for example, each pixel of a thermal image, could be associated with a positioning system, such as a global positioning system. A computer, such as electronic control unit 32, could then store data from the entire area as temperature data with the corresponding position data. Each data set, of temperature data and position data, could also be associated with time data, such that each sensed area of a mat could have a temperature coordinate, a position coordinate and a time coordinate. Where multiple lifts of paving material are used, a lift number coordinate could also be used. The data sets could then be retrieved to allow a technician, etc. to later view displays of a complete thermal history of a paved work area.

Figure 3:
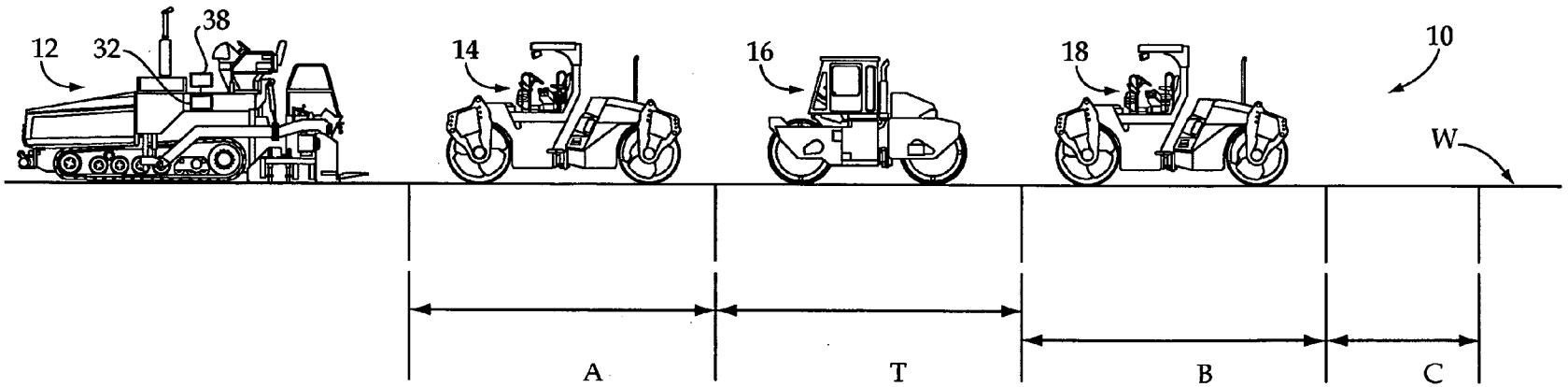
FIG. 3 is a diagrammatic view of paving system of FIG. 1 in a second machine positioning configuration.

It will further be recalled that sensed paving material temperature may be compared with paving material temperature predicted by the positional temperature model. The comparison may take place, for example, with electronic control unit 32, which will typically output signals corresponding to a difference between the positional temperature model and temperature data gathered via one or more of sensors 26*a-d*. During operation of system 10, situations may develop where one or more of the machines of system 10 is working paving material which is not at an optimum temperature for the particular type of work, or is not within an optimum temperature range. For example, by sensing paving material temperature, machine position, etc., it may be discovered that one of compacting machines 14, 16 and 18 is attempting to compact paving material which is in the tender zone, or is progressing toward paving material which is in the tender zone. Referring to FIG. 3, there is shown an example representation of paving system 10 wherein compacting machine 16 is working paving material which is determined to be in zone T, the tender zone for the particular paving material mix. Similar to the FIG. 2 illustration, it should be appreciated that an operator, foreman, etc. might view a map similar to FIG. 3, but could also view any other suitable graphical representation of the relevant portion of a work area, and the machine(s) within that area.

When it is determined that one or more of the machines of system 10 is working or is about to work paving material which is too hot or too cool, a control signal to the machine may be output via electronic control unit 32, via transmitter 30*a*, for example. In one embodiment, the control signal could comprise a machine navigation signal which directs the subject machine, in the illustrated case machine 16, to stop, reduce its speed, maintain a particular spacing from machine 14, or to take a variety of other actions. The case where machine 16 is compacting paving material which is within the tender zone might occur, for example, where machine 16 is traveling above a specified speed and begins to get too close to machine 14 such that the paving material does not have sufficient time to cool after being compacted with machine 14. Such a situation might also occur where environmental conditions change and the paving material cools more slowly than expected, for instance where ambient temperature rises significantly over the course of a work day.

While avoiding the tender zone of paving material is contemplated to be one practical implementation of the present disclosure, numerous other instances exist where system 10 can be controlled to accommodate paving material temperatures which are different from expected temperatures. For instance, where paving material temperature immediately behind paving machine 12 is determined to be too cool, electronic control unit 32 may output control signals to conveyor system 23 to increase its rate of supplying paving material to screed 24, and may also output control signals to a propulsion system of machine 12 (not shown) to increase the speed of operation of ground engaging elements 22 to increase machine travel speed. Simultaneously, machine speed signals could be output to other machines of system 10 to accommodate an increased paving speed. Signals may also be sent to supply machine, or even an asphalt plant, to speed up the rate at which paving material is supplied to system 10.

INDUSTRIAL APPLICABILITY

Figure 4:
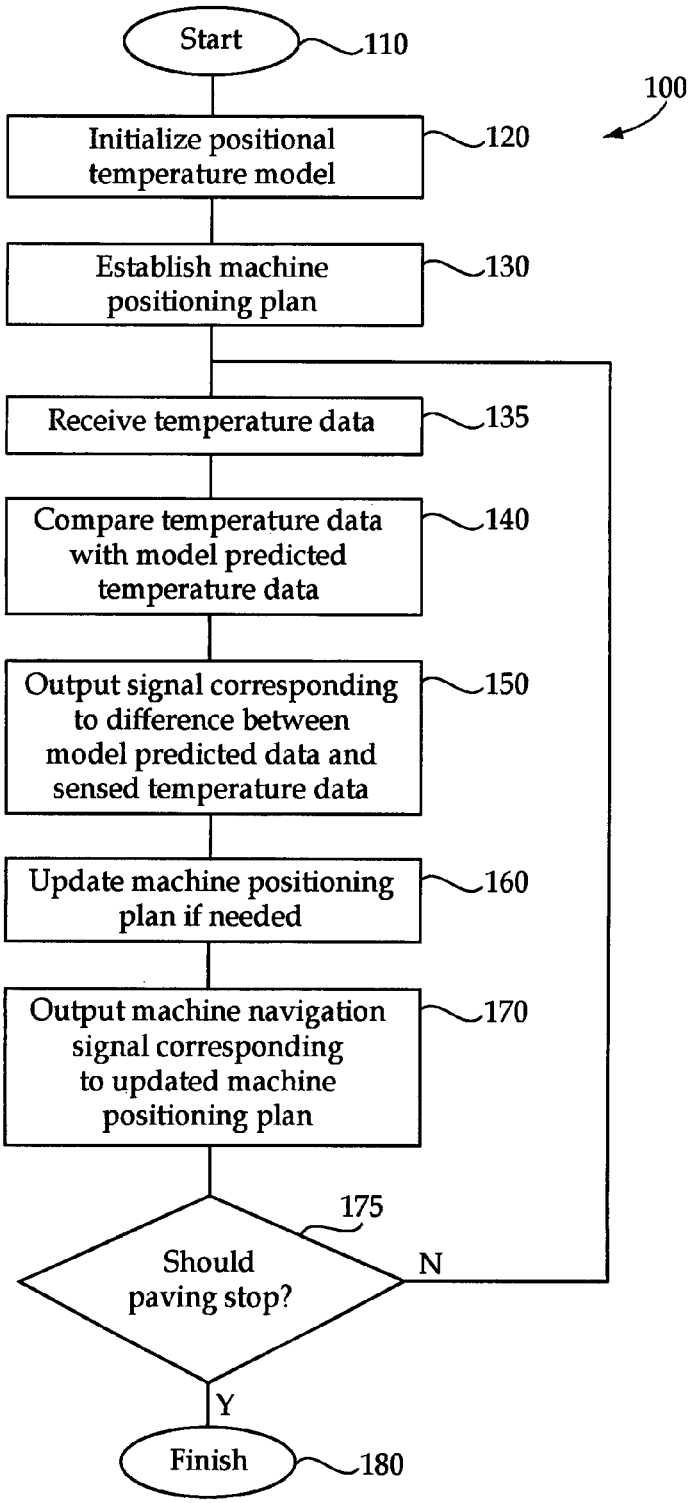
FIG. 4 is a flowchart illustrating an example process according to the present disclosure.

Turning now to FIG. 4, there is shown a flowchart 100 illustrating an exemplary control process according to the present disclosure. The process of flowchart 100 may begin at step 110, START, and may then proceed to step 120 wherein a positional temperature model is initialized. As discussed above, initialization of the positional temperature model may include inputting values for one or more model parameters which allow a prediction of paving material temperature at any of numerous possible positions within or relative to machines of system 10, or geographic positions. Humidity, cloud cover, ambient temperature, asphalt mix type, wind speed, etc. may all be input to the positional temperature model. From step 120, the process may proceed to step 130 wherein a machine positioning plan or another plan such as a plan for machine speed, etc. is established. The plan may be a relatively simple plan wherein a spacing between machines 14 and 16 to avoid the tender zone is selected based on the positional temperature model. Relatively more sophisticated plans may also be used, wherein a plurality of different parameters such as machine speed, vibratory amplitude and frequency for vibratory apparatuses of one or more of the compacting machines, screed heating, etc., may be determined.

It should thus be understood that "machine positioning" is but one example of the many different factors which might be determined based on the positional temperature model. In still other embodiments, rather than initializing the model each time a particular job is begun, a one-size fits all positional temperature model might be used, developed empirically or via computer simulation, for example. Plan data corresponding to the established plan may be recorded in memory 34, memory 64, etc. by the appropriate electronic control unit 32, 62 via a memory writing device such as memory writing device 63. In one embodiment, establishing of the plan may be performed by the subject electronic control unit which actually calculates the appropriate machine operating parameters such as speed, positioning, etc. which correspond with the plan, and are ultimately based on the positional temperature model. A one-size fits all plan based on a one-size fits all positional temperature model might also be used. In still other embodiments, the plan might be established manually by operators, foremen, etc.

From step 130, appropriate machine navigation signals to the various machines of system 10 may be output, for example, via signaling device 30*a* to commence paving, and the process may proceed to step 135 wherein electronic data, including temperature data of paving material, is received. As discussed above, temperature data might include temperature data at positions of a paving material mat relative to one of the machines of system 10, mapped locations of a work area, temperature data for paving material within a machine, etc. From step 135, the process may proceed to step 140 wherein the temperature data is compared with model predicted temperature data. From step 140, the process may proceed to step 150 wherein a signal is outputted which corresponds to a difference between model predicted temperature data and sensed temperature data. The signal may be an alert signal indicating that one or more of the machines of system 10 is working paving material in the wrong temperature range, or indicating that a risk is detected that one or more of the machines of system 10 is about to work paving material in the wrong temperature range, etc. In other instances, the signal may simply confirm that paving is taking place in an optimal manner.

From step 150, the process may proceed to step 160 wherein the plan is updated if necessary, by overwriting recorded plan data, to conform to changed conditions which are responsible for differences between actual sensed temperature and the model predicted temperature. For example, it may be determined that machines 14 and 16 are traveling too close together, and the specified distance between them should be changed. Other examples of updating the plan or recorded plan data might include updating a specified number of passes to be performed with one or more of compactors 14, 16, 18 over a particular region of the mat. There might of course be no difference, or very little difference, between sensed temperature and predicted temperature and the plan need not be updated. From step 160, the process may proceed to step 170 wherein a signal is outputted which comprises a machine navigation signal corresponding to the updated plan. As discussed above, a variety of different actions such as changing machine positioning, changing machine speed, etc., may be taken in response to the signal. In instances where the plan does not need to be updated, the process may loop back to an earlier step such as step 135 rather than executing step 160, or might exit. From step 170, the process may proceed to step 175 to query whether paving should stop. If no, the process may loop back to step 135. If yes, the process may proceed to FINISH at step 180.

Figure 5:
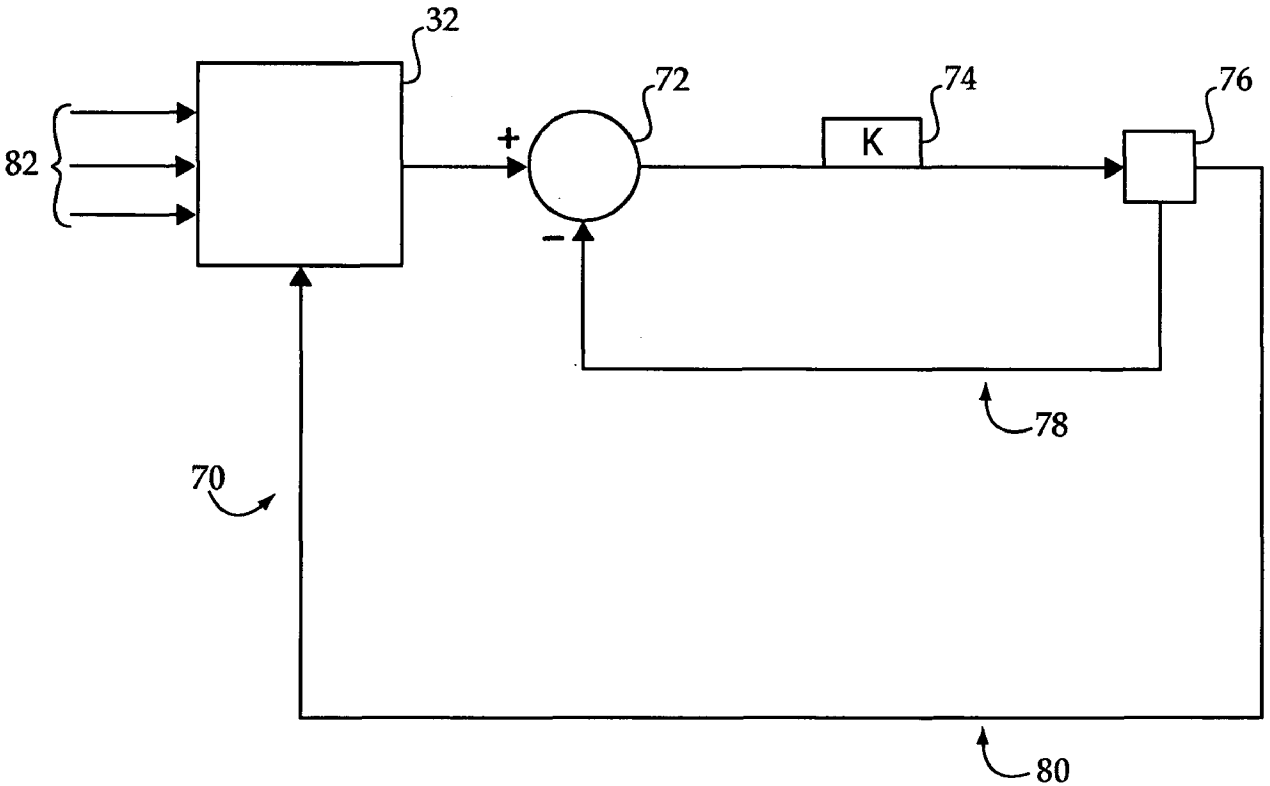
FIG. 5 is a control loop schematic according to the present disclosure.

Control over system 10 may take place via a closed loop control algorithm comprising computer executable code stored on a computer readable memory such as memory 34, 64. Turning to FIG. 5, there is shown a control loop schematic 70 according to the present disclosure which further illustrates certain of the control aspects described herein. Electronic control unit 32 is shown in FIG. 5 receiving inputs 82 representative of parameters input to initialize the positional temperature model. As described herein, control unit 32 may establish a plan for paving a work area based on the subject positional temperature model. A summer 72 is also shown, as is a signal gain 74 and a system response 76. Control unit 32 may initially determine values for control signals such as machine navigation signals, for example, based on the established plan. Summer 72 may recalculate the signal values via an inner loop 78 based on system response 76. In other words, summer 72 can vary signal values initially determined by control unit 32 based on sensor data. For example, control unit 32 might initially calculate machine speeds or positioning based on a particular plan which are expected to result in certain machines working paving material at certain temperatures. System response 76 may be different than expected, however, as actual temperatures of the paving material may differ from predicted temperatures. Summer 72 can recalculate the signal values based on a difference between predicted data and expected data, and thus control system 10 in a closed loop fashion such that system response 76 achieves or approaches a desired response.

It will be recalled that electronic control unit 32 may rely at least in part upon a plan which is based on a positional temperature model to generate control signals for operating the various machines of system 10. As discussed above, conditions may change over the course of paving a particular work area which make updating the plan desirable. An outer loop 80 is shown in FIG. 5 which represents a means for updating the plan based on system response 76. In other words, electronic control unit 32 may be configured via outer loop 80 to update the plan in a closed loop fashion. Outer loop 80 may be understood as a relatively fast loop, whereas inner loop 78 may be understood as a relatively slow loop.

The present approach is contemplated to provide superior results over other strategies, including other closed loop strategies, lacking the insight to proceed in a planned manner. By providing a starting point, e.g. a plan, for operating system 10 which is based on expected temperature decay in paving material over time, adjustments to system 10 can be expected to achieve or approach a desired system response relatively more rapidly than paving strategies which commence with little or no forethought. In other words, by proceeding in a planned manner differences between an actual system response, e.g. actual paving material temperature at a particular position, and a predicted system response, e.g. predicted paving material temperature at a particular position, can be expected to be less than in certain other systems. Moreover, the plan can itself be updated as paving progresses in response to changed conditions. Each of these aspects of the present disclosure are made possible in part by comparing sensed data with data predicted by the positional temperature model.

In a related aspect, comparing sensed data such as paving material temperature data may be used to refine the positional temperature model itself. The closed loop control algorithm described in connection with FIG. 5 may comprise a learning algorithm whereby electronic control unit 32 updates the positional temperature model based on a difference between actual data and model predicted data for a given set of conditions such as wind speed, humidity, cloud cover, and the other model parameters described and contemplated herein as bearing on the rates at which paving material temperature decays. For instance, a given positional temperature model might consider a first factor such as cloud cover, wind speed, etc., to be relatively more significant with regard to the rate of paving material temperature decay than a second factor. Over the course of one or more paving jobs, the impact of the first factor on temperature decay may be determined to be less than previously supposed, or possibly cross-coupled with other factors, for example.

By continuously or intermittently monitoring paving material temperature, and comparing with an expected temperature, feed forward control over paving system 10 is also possible. The present disclosure may afford the opportunity to determine that paving material temperature is changing more rapidly, or more slowly, than expected. Factors such as machine speed, spacing, and even the supply rate or production rate of paving material can then be proactively adjusted prior to problems developing, for example prior to one of compactors 14 and 16 attempting to compact paving material which is within the tender zone.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. For example, while much of the foregoing description focuses on temperature sensing via temperature sensors mounted on the machines of system 10, the present disclosure is not thereby limited. In other embodiments, separate machines such as unmanned drones might be used which travel across or near the asphalt mat, gathering temperature data and possibly even scanning machine position data as a paving job progresses. Other aspects, features and advantages will be apparent upon an examination of the attached drawings and appended claims.

What is claimed is:

1. A method of operating a paving system comprising the steps of:

establishing a plan for paving a work area with the paving system which is based on a positional temperature model for paving material recorded in a computer readable memory;

outputting machine navigation signals which are based on the plan to a paving machine, a compacting machine or a supply machine, of the paving system;

receiving electronic data that includes temperature data for a paving material subsequent to outputting the machine navigation signals; and comparing the electronic data with data predicted by the positional temperature model.

2. The method of claim 1 wherein the step of receiving electronic data further comprises receiving temperature data from a temperature sensor of the paving system during paving the work area, the method further comprising a step of outputting a signal in response to comparing the electronic data with predicted data.

3. The method of claim 2 wherein the step of receiving electronic data further comprises receiving position data from a position sensor mounted on the paving machine, the compacting machine, or the supply machine, the method further comprising a step of mapping paving material temperature within a work area based on the temperature data and the position data.

4. The method of claim 3 further comprising a step of recording temperature mapping data and model comparison data corresponding to the temperature mapping data in a computer readable memory.

5. The method of claim 2 wherein the positional temperature model comprises a temperature decay model, and wherein the comparing step comprises comparing a sensed paving material temperature with a paving material temperature predicted by the temperature decay model.

6. The method of claim 5 further comprising a step of initializing the positional temperature model by inputting values for a plurality of model parameters.

7. The method of claim 2 further comprising a step of updating the plan based on comparing the electronic data with the data predicted by the positional temperature model.

8. The method of claim 2 wherein the step of outputting a signal comprises outputting a machine navigation signal.

9. The method of claim 8 wherein:

the step of receiving electronic data includes receiving data indicative of a position of a first machine of the paving system relative to a second machine of the paving system; and the method further comprising a step of controlling a relative position between the first and second machines in a manner which is responsive to the machine navigation signal.

10. The method of claim 8 wherein:

the step of receiving electronic data includes receiving data indicative of a position of at least one compacting machine relative to a region of the mat having a temperature within a predefined temperature range;

the method further comprising a step of controlling a position of the at least one compacting machine relative to the region of the mat in a manner which is responsive to the machine navigation signal.

11. The method of claim 10 wherein the step of receiving electronic data includes receiving data indicative of a position of each of two compacting machines relative to a region of the paving material mat having a temperature within a tender zone of the paving material, and wherein the step of controlling a position of the at least one compacting machine comprises controlling a position of each of the compacting machines.

12. A paving system comprising:

at least one machine having a frame and ground engaging elements mounted to said frame, and being configured to interact with a paving material, said at least one machine including a paving machine, a compacting machine, or a supply machine;

a control system which includes an electronic control unit, a computer readable memory, and a memory writing device;

said electronic control unit being configured via said memory writing device to record plan data on said computer readable memory for paving a work area, wherein the plan data is based on a positional temperature model recorded on said computer readable memory;

said electronic control unit being further configured to receive electronic data which includes temperature data for the paving material, and to compare said electronic data with data predicted by said positional temperature model.

13. The paving system of claim 12 further comprising a signaling device, said electronic control unit being configured via said signaling device to output machine navigation signals to at least one machine of said paving system which are based on said plan data.

14. The paving system of claim 13 wherein said electronic control unit is further configured via said memory writing device to update said plan data on comparing said electronic data with said predicted data.

15. The paving system of claim 13 wherein said at least one machine comprises a paving machine, and said paving system further comprises a plurality of compacting machines each having a receiver configured to receive said machine navigation signals and a transmitter configured to output data signals comprising paving material temperature data and machine position data associated with the corresponding compacting machine.

16. The paving system of claim 15 wherein said electronic control unit is further configured via said memory writing device to record temperature mapping data and model comparison data based on said data signals on said computer readable memory.

17. A paving control system comprising:

a computer readable memory;

a memory writing device; and an electronic control unit configured via said memory writing device to record a positional temperature model for paving material on said computer readable memory, and also configured to record plan data for paving a work area with a paving system on said computer readable memory which is based on said positional temperature model;

said electronic control unit being further configured to receive electronic data including temperature data for a paving material and to output a signal based on a difference between said electronic data and data predicted by said positional temperature model.

18. The paving control system of claim 17 further comprising a signaling device coupled with said electronic control unit, wherein said electronic control unit is configured to determine said plan data based on said positional temperature model, and further configured via said signaling device to output machine navigation signals for a plurality of machines of said paving system which are based on said plan data.

19. The paving control system of claim 18 wherein said computer readable memory stores a closed loop control algorithm comprising computer executable code, said closed loop control algorithm comprising an outer loop and an inner loop, and said electronic control unit being configured via said outer loop to update said plan data and configured via said inner loop to determine said machine navigation signals.

20. The paving control system of claim 19 wherein said closed loop control algorithm comprises a learning algorithm, and wherein said electronic control unit is configured via said learning algorithm to update said positional temperature model based on comparing said electronic data with said predicted data.

21. A paving control system comprising:

an electronic control unit; and a computer readable and writable memory coupled with the electronic control unit;

the electronic control unit being configured to record plan data on the computer readable and writable memory for paving a work area via a paving system, wherein the plan data is based on an electronically recorded positional temperature model; and the electronic control unit being further configured to receive electronic temperature data for a paving material used in paving the work area, and to output a signal based on a difference between the electronic temperature data and temperature data predicted by the positional temperature model.

* * * * *